US006041607A

United States Patent [19]

Kim

[11] Patent Number: 6,041,607

[45] Date of Patent: Mar. 28, 2000

[54] REFRIGERATOR HAVING A LIQUID SUPPLYING DEVICE FOR AN ICE TRAY

[75] Inventor: Jae-Hee Kim, Seoul, Rep. of Korea

[73] Assignee: Daewoo Electronics Co., Ltd., Seoul, Rep. of Korea

[21] Appl. No.: 09/213,877

[22] Filed: Dec. 17, 1998

[30] Foreign Application Priority Data

Oct. 31, 1998 [KR] Rep. of Korea ..... 98-46874

[51] Int. Cl.[7] ..... F25C 1/12

[52] U.S. Cl. ..... 62/188; 62/137; 137/487.5; 222/59

[58] Field of Search ..... 62/188, 189, 347; 137/487.5; 222/59

[56] References Cited

U.S. PATENT DOCUMENTS

| | | | |
|---|---|---|---|
| 3,059,445 | 10/1962 | Kniffin | 62/135 |
| 4,073,159 | 2/1978 | Trippi | 62/340 |
| 5,125,120 | 6/1992 | Baron | 222/59 |
| 5,425,248 | 6/1995 | Trantina | 62/349 |
| 5,555,743 | 9/1996 | Hatanaka | 62/347 |
| 5,829,263 | 11/1998 | Park | 222/59 |
| 5,904,054 | 5/1999 | Lee | 62/347 |
| 5,946,924 | 9/1999 | Kim | 62/189 |

*Primary Examiner*—William E. Tapolcai
*Attorney, Agent, or Firm*—Pillsbury Madison & Sutro LLP

[57] ABSTRACT

A refrigerator which can supply water from a household water supply system into an ice tray, or alternatively, can supply water from a separate water tank into the ice tray. The refrigerator has a housing having a refrigerating chamber, a freezing chamber, and an evaporator chamber which is disposed at a rear portion of the freezing chamber, an ice tray disposed in the freezing chamber, a motor assembly for rotating the ice tray when a liquid filled in the ice tray is frozen, a valve box installed on an upper surface of the housing for receiving the liquid from a household water supply system or from a liquid tank, a fluid path for guiding the liquid from the valve box to the ice tray, a rotating fan assembly for detecting an amount of the liquid flowed into the ice tray, a solenoid valve assembly for adjusting the amount of the liquid being supplied into the ice tray, and an electric control unit for operating the solenoid valve assembly based on an electric signal inputted from the rotating fan assembly.

12 Claims, 6 Drawing Sheets

REFRIGERATOR HAVING A LIQUID SUPPLYING DEVICE FOR AN ICE TRAY

BACKGROUND OF THE INVENTION

1. Field of the Invention

The present invention relates to a refrigerator, and more particularly to a refrigerator having a liquid supplying device which can not only supply water from a household water supply system into an ice tray, but also supply water from a separate water tank into the ice tray.

2. Description of the Prior Art

Generally, a refrigerator is an apparatus for storing various foods in either a frozen or refrigerated condition to keep freshness of foods for a long time. Such a refrigerator includes a compressor which circulates a refrigerant by compressing the refrigerant, a condenser for condensing the refrigerant to a liquid phase, and an evaporator for generating a chilled air by evaporating the liquid phase refrigerant.

The refrigerator has a freezing chamber for storing frozen foods such as meats or an ice cream, and a refrigerating chamber for storing foods at a relatively lower temperature. The chilled air generated by the evaporator is introduced into the refrigerating and freezing chambers by a fan.

An ice maker having an ice tray is installed in the freezing chamber for making an ice by using the low temperature of the freezing chamber. The ice tray receives water from a household water supply system or from a separate liquid supplying device installed in the refrigerator.

However, since the liquid supplying device is installed in the refrigerator, a usable space in the refrigerator is reduced and a structure of the refrigerator is complicated.

In order to overcome the above problem, refrigerators having a liquid supplying device at an outside thereof have been developed. Recently, there has been suggested a liquid supplying device which can supply water from the household water supply system into an ice tray, or alternatively, can supply a liquid from a separate water tank having a juice or fresh water into the ice tray.

For example, U.S. Pat. No. 4,073,159 issued to Anthony C. Trippi discloses a bypass dispenser unit which can not only supply water from a household water supply system into an ice tray, but also supply a liquid, such as a juice or fresh water, from a separate water tank into the ice tray.

FIG. 1 shows Trippi's bypass dispenser unit. In FIG. 1, reference number 10 indicates a refrigerator having a freezing chamber 12 and a refrigerating chamber 14. Freezing chamber 12 includes an ice maker 16 which freezes water into ice cubes. Ice maker 16 is connected to a cold water pipe 18, which is a part of the household water supply system, by way of a supply line 20. Cold water pipe 18 is connected to a shut-off valve 24.

Refrigerator 10 includes a cold water spigot 26 which receives water through a water inlet. The water inlet is provided with a heating coil 28. Reference number 30 indicates a dispenser unit. Dispenser unit 30 is connected to supply line 20 by a pair of T-connectors 32 and 34. A bypass valve 36 is provided between the pair of T-connectors 32 and 34 and is connected to supply line 20. An input line 38 is connected to T-connecter 32 through a shut-off valve 40 and an output line 42 is connected to T-connecter 34 through a shut-off valve 44.

Dispenser unit 30 includes a rigid container 46 having a collapsible canister 56 therein. A lid 50 is mounted on an upper portion of container 46.

Canister 56 is filled up with a juice or other liquid to be dispensed. In addition, a nipple 59 is provided at a neck portion of canister 56. Nipple 59 is clamped by a clamping band 62 provided at an upper portion of nipple 59.

Dispenser unit 30 having the above structure operates as follows.

When water is supplied into ice maker 16, valve 36 is opened and valves 40 and 44 are closed. In this state, water is supplied into ice maker 16 through cold water pipe 18 and supply line 20 in a conventional manner.

In addition, when the juice or other liquid contained on canister 56 is supplied into ice maker 16, valve 36 is closed and valves 40 and 44 are opened.

Therefore, water is supplied into container 46 through cold water pipe 18, valve 40 and input line 38. Water supplied into container 46 applies a pressure to canister 56, so canister 56 is collapsed. Accordingly, the juice or other liquid contained in canister 56 is supplied into ice maker 16 through output line 42, valve 44 and supply line 20.

However, dispenser unit 30 should apply a high hydraulic pressure to canister 56 for supplying the juice or other liquid into ice maker 16. If the hydraulic pressure of water is low, it takes much time to supply the juice or other liquid into ice tray 16.

In addition, after the juice or other liquid has been supplied into ice tray 16, a waste of water takes place because the water contained in container 46 has to be drained.

SUMMARY OF THE INVENTION

The present invention has been made to overcome the above described problem of the prior art. Accordingly, it is an object of the present invention to provide a refrigerator having a liquid supplying device which can not only supply water from a household water supply system into an ice tray, but also supply water from a separate water tank into the ice tray.

To accomplish the object of the present invention, there is provided a refrigerator comprising:

- a housing having a refrigerating chamber, a freezing chamber, and an evaporator chamber which is disposed at a rear portion of the freezing chamber;
- an ice tray disposed in the freezing chamber;
- a motor assembly for rotating the ice tray when a liquid filled in the ice tray is frozen, the motor assembly being installed in the evaporator chamber;
- a first means for receiving the liquid from a household water supply system or from a liquid tank, the first means being installed on an upper surface of the housing and alternatively connected to the household water supply system or to the liquid tank;
- a second means for guiding the liquid from the first means to the ice tray;
- a third means for detecting an amount of the liquid flowed into the ice tray;
- a fourth means for adjusting the amount of the liquid being supplied into the ice tray; and
- an electric control unit for operating the fourth means based on an electric signal inputted from the third means.

According to preferred embodiment of the present invention, the first means includes a valve box coupled to the upper surface of the housing, a T-connector connected to one side of the valve box for allowing the liquid to flow from the liquid tank or the household water supply system into the valve box, and first and second caps for selectively sealing one of both ends of the T-connector.

The T-connector includes a horizontal pipe and a vertical pipe integrally formed at a center of the horizontal pipe and connected to the valve box. A first end of the horizontal pipe is adapted for connecting to the household water supply system, a second end of the horizontal pipe is adapted for connecting to the liquid tank. The first cap seals the first end of the horizontal pipe when the second end of the horizontal pipe is connected to the liquid tank, and the second cap seals the second end of the horizontal pipe when the first end of the horizontal pipe is connected to the household water supply system.

The second means includes a circular chamber which is formed between an upper wall of the housing and an upper wall of the freezing chamber so that the circular chamber is communicated with the valve box, and a duct integrally formed at the upper wall of the freezing chamber so as to communicated with the circular chamber and extended by a predetermined distance towards the ice tray.

The third means includes a rotating fan assembly installed in the circular chamber. The rotating fan assembly has a cylindrical boss, a plurality of wings provided around the cylindrical boss, and a revolution per minute sensor for detecting revolutions of the wings.

The fourth means includes a cylinder integrally formed at an inner upper wall of the valve box and a solenoid valve assembly installed in the cylinder.

The liquid is supplied into the ice tray as follows.

Firstly, if a user want to supply the liquid from the household water supply system, the user seals the second end of the horizontal pipe by using the second cap and connects the first end of the horizontal pipe to the household water supply system.

In this state, the liquid is introduced into the ice tray through the household water supply system, the valve box, the circular chamber and the duct.

At this time, the revolution per minute sensor of the rotating fan assembly detects revolutions of the wings and sends the detected data to the electric control unit.

When the revolution number of the wings reach a predetermined value, the electric control unit stops the operation of the solenoid valve assembly so that a piston valve of the solenoid valve closes the port.

When the ice making is completed, the electric control unit operates the reversible motor to rotate the ice tray at an angle of 180 degrees. Accordingly, ice cubes contained in the ice tray is dropped from the ice tray.

On the other hand, if the user want to supply the liquid from the liquid tank, the user seals the first end of the horizontal pipe by using the first cap and connects the second end of the horizontal pipe to the pipe of the liquid tank.

The liquid supplying device of the present invention supplies the liquid from the upper portion of the ice tray, so there is no need to provide a pump for pumping the liquid into the upper portion of the ice tray.

In addition, since the liquid supplying device is separately installed on the upper surface of the housing, there is no need to provide a space in the refrigerator for installing the liquid supplying device. Accordingly, the usable space in the refrigerator increases and manufacturing cost decreases.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, a preferred embodiment of the present invention will be explained in detail with reference to the accompanying drawings.

Figure 1:
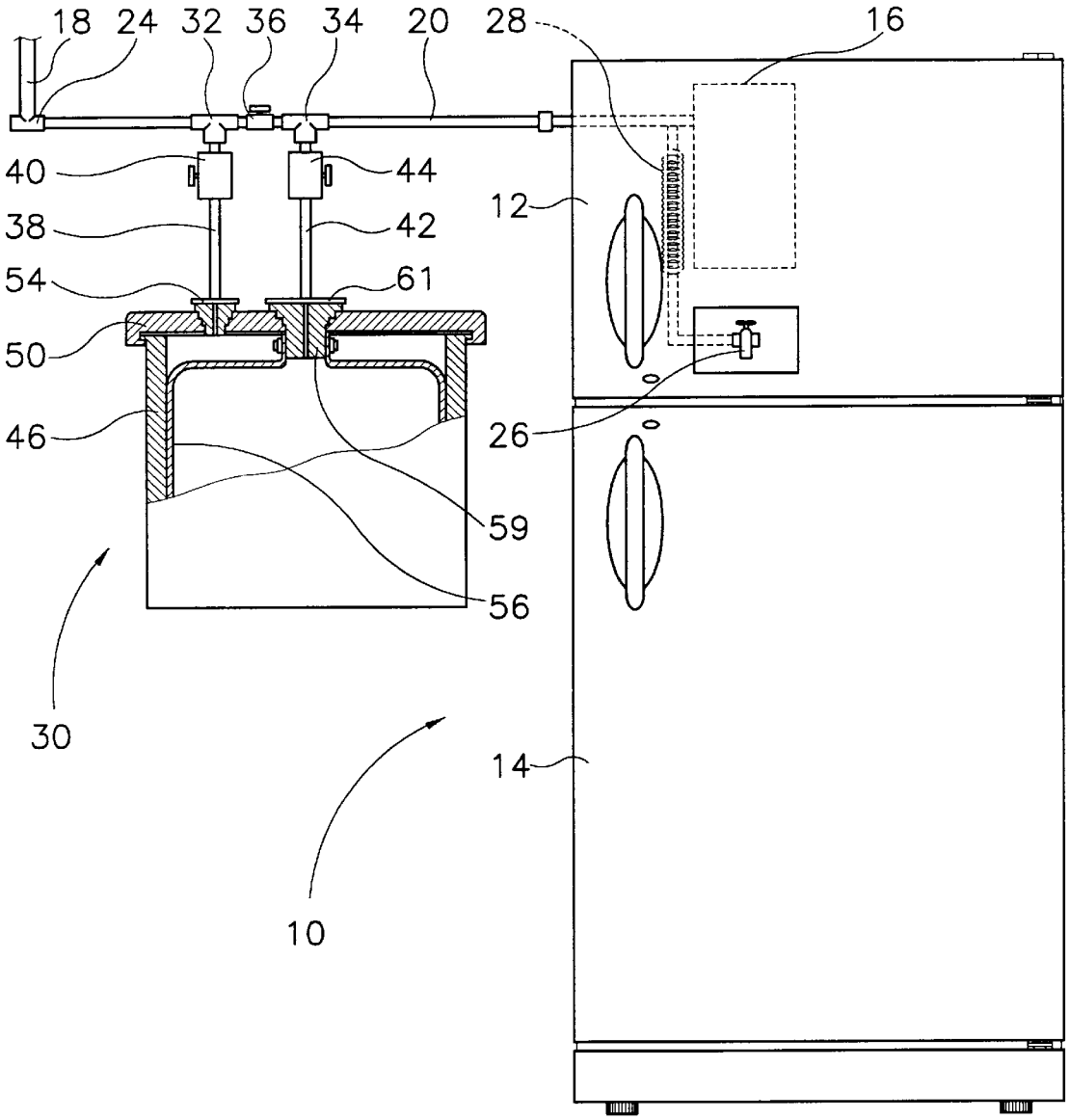
FIG. 1 (PRIOR ART)
FIG. 1 is a front view showing a conventional refrigerator having a dispenser unit.
Figure 2:
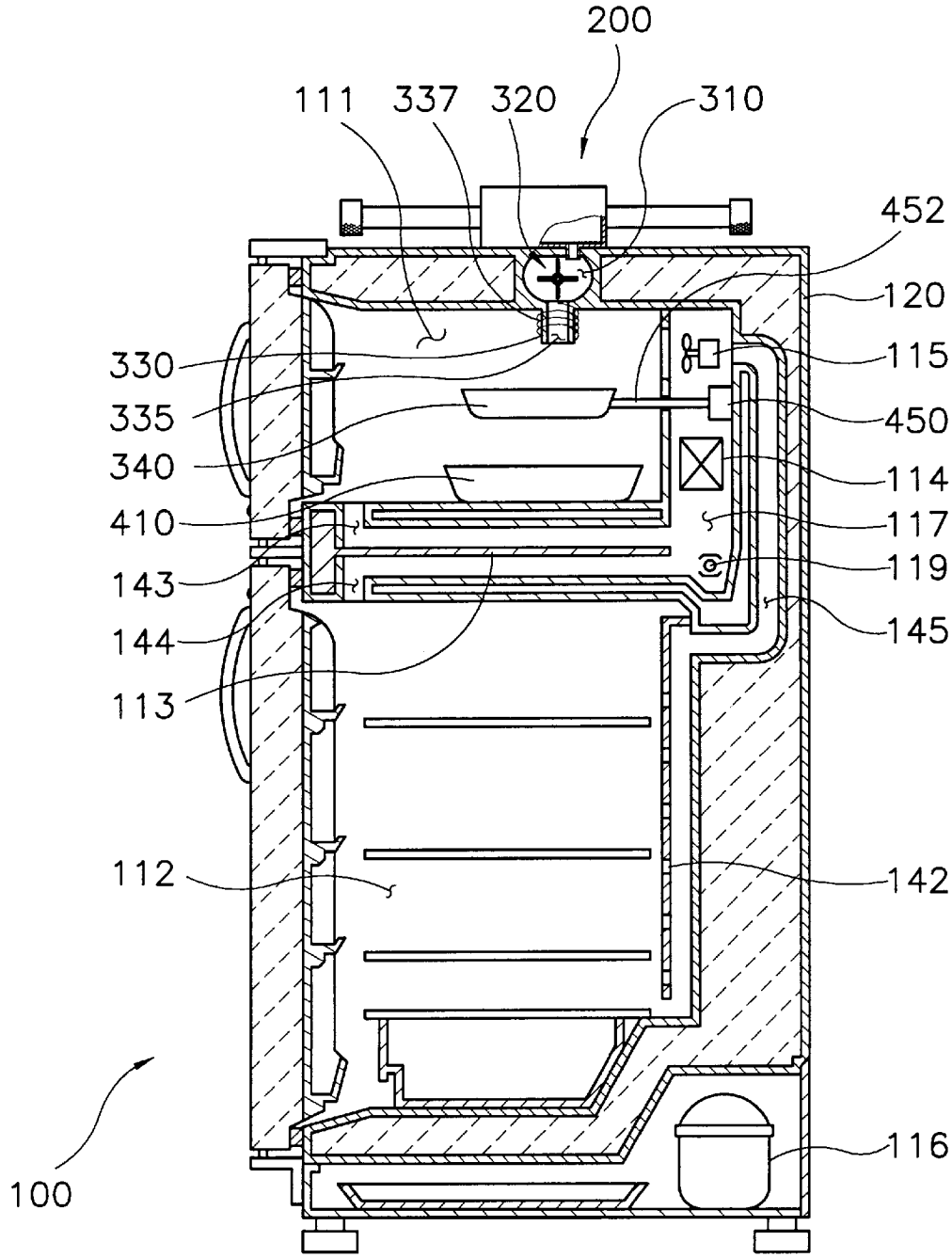
FIG. 2 is a sectional view showing a refrigerator having a liquid supplying device for an ice tray according to one embodiment of the present invention.

FIG. 2 shows a refrigerator 100 having a liquid supplying device 200 according to one embodiment of the present invention.

As shown in FIG. 2, refrigerator 100 comprises a housing 120 having a refrigerating chamber 112 and a freezing chamber 111 which is separated from refrigerating chamber 112 by a partition wall 113. An evaporator chamber 117, in which an evaporator 114 is installed, is formed at a rear portion of freezing chamber 111. A compressor 116 is disposed below refrigerating chamber 112 and a condenser (not shown) is connected between compressor 116 and evaporator 114.

Compressor 116 compresses a refrigerant to a high-pressure and high-temperature refrigerant, and the condenser makes a liquid-phase refrigerant by discharging a heat from the high-pressure and high-temperature refrigerant. The liquid phase refrigerant is supplied to and evaporated by evaporator 114, thereby generating a chilled air. In addition, a heater 119 is installed below evaporator 114 so as to defrost a frost adhering to evaporator 114.

Installed above evaporator 114 is a fan assembly 115 for blowing an air toward freezing chamber 111. In addition, some of the chilled air is introduced into refrigerating chamber 112 through a chilled air duct 145 formed at a rear portion of evaporator chamber 117 and through a chilled air inlet 142 which is formed at a rear wall of refrigerating chamber 112. The chilled air which has been introduced into freezing and refrigerating chambers 111 and 112 is re-circulated into evaporator chamber 117 through first and second chilled air return passages 143 and 144 which are formed at a lower portion of freezing chamber 111 and at an upper portion of refrigerating chamber 112, respectively.

An ice tray 340 is provided in freezing chamber 111. Ice tray 340 is connected to a rotating shaft 452 of a reversible motor 450 installed in evaporator chamber 117. When water filled in ice tray 240 has been frozen, reversible motor 450 rotates ice tray 340 at an angle of 180 degrees so that ice cubes contained in ice tray 340 are dropped into an ice reservoir 410 installed below ice tray 340.

Liquid supplying device 200 for supplying a liquid, such as water, into ice tray 340 is disposed on an upper surface of housing 120. Liquid supplying device 200 will be more detailedly explained below with reference to FIGS. 3 to 6.

Between an upper wall of housing 120 and an upper wall of freezing chamber 111, there is formed a circular chamber 310 for guiding the liquid from liquid supplying device 200 into ice tray 340.

Provided in circular chamber 310 is a rotating fan assembly 320 for detecting an amount of the liquid flowed into ice tray 340. In addition, a duct 330 is integrally formed at the upper wall of freezing chamber 111. Duct 330 is communicated with circular chamber 310 and extends by a predetermined distance towards ice tray 340. Duct 330 has a heating coil 337 for preventing duct 330 from freezing and is formed at a center thereof with a fluid path 335.

Figure 3:
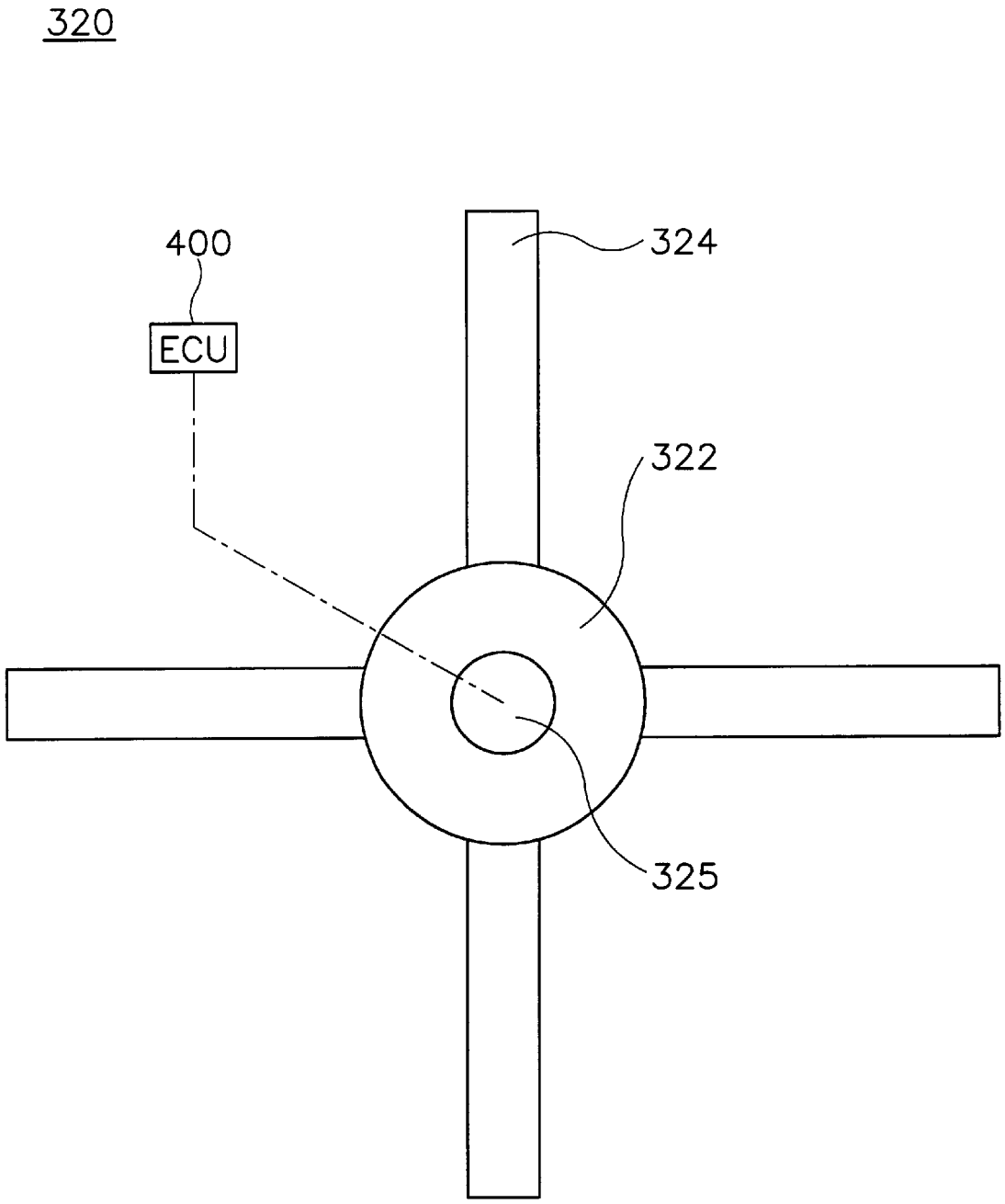
FIG. 3 is an enlarged view of a rotating fan assembly shown in FIG. 2.

As shown in FIG. 3, rotating fan assembly 320 has a cylindrical boss 322, a plurality of wings 324 provided around cylindrical boss 322, and a revolution per minute sensor 325 installed at a predetermined portion of cylindrical boss 322 for detecting a revolution of wings 324. Revolution per minute sensor 325 is connected to an electric control unit 400 for sending a detected data to electric control unit 400. Revolution per minute sensor 325 includes a HALL sensor which makes an electromagnetic action with respect to magnets (not shown) installed on wings 324.

Figure 4:
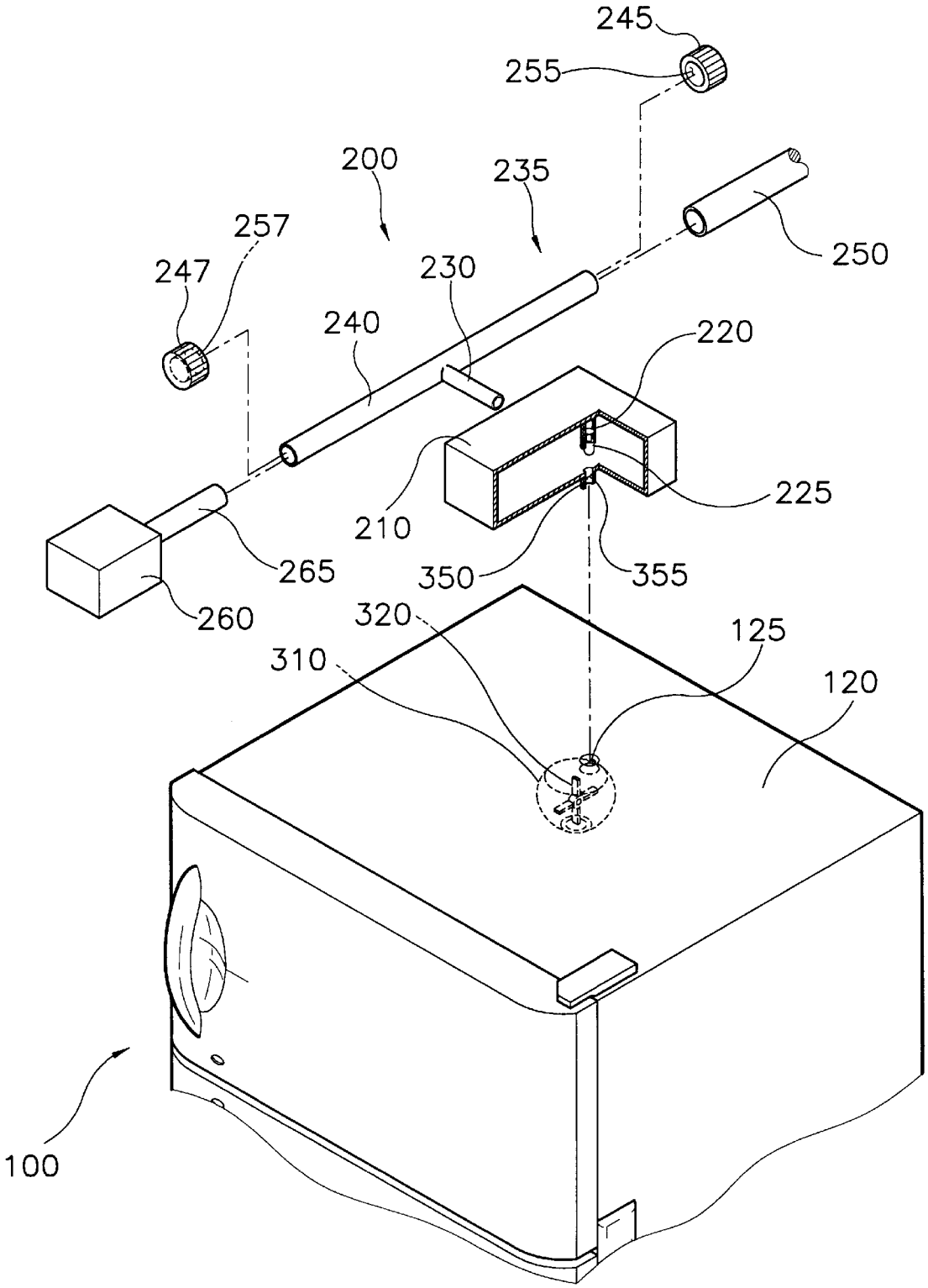
FIG. 4 is an exploded perspective view showing a liquid supplying device and a refrigerator according to one embodiment of the present invention.

Referring to FIG. 4, liquid supplying device 200 has a valve box 210 coupled to the upper surface of housing 120, a T-connector 235 connected to one side of valve box 210 for allowing the liquid to flow from a liquid tank 260 or from a supply pipe 250 of a household water supply system into valve box 210, and first and second caps 245 and 247 for selectively sealing either end of T-connector 235. Supply pipe 250 is a part of the house hold water supply system and includes a flexible pipe.

Valve box 210 is integrally formed at an underside thereof with a port 350 extending downward. Port 350 has a fluid path 355 and is inserted into an opening 125 formed at the upper surface of housing 120 so that valve box 210 is secured to the upper surface of housing 120. Since opening 125 is communicated with circular chamber 310, valve box 210 is communicated with circular chamber 310 through opening 125.

On the other hand, one of wings 324 of rotating fan assembly 320 is arranged corresponding to a position of port 350 of valve box 210 so that wings 324 rotate by a hydraulic pressure of the liquid dropped from port 350.

A cylinder 220 is integrally formed at an inner upper wall of valve box 210. Cylinder 220 is arranged in line with port 350. In addition, a solenoid valve assembly 225, which opens or closes port 350 for adjusting the amount of the liquid being supplied into ice tray 340, is installed in cylinder 220. Solenoid valve assembly 225 is connected to electric control unit 400 so as to be controlled by electric control unit 400.

Figure 5:
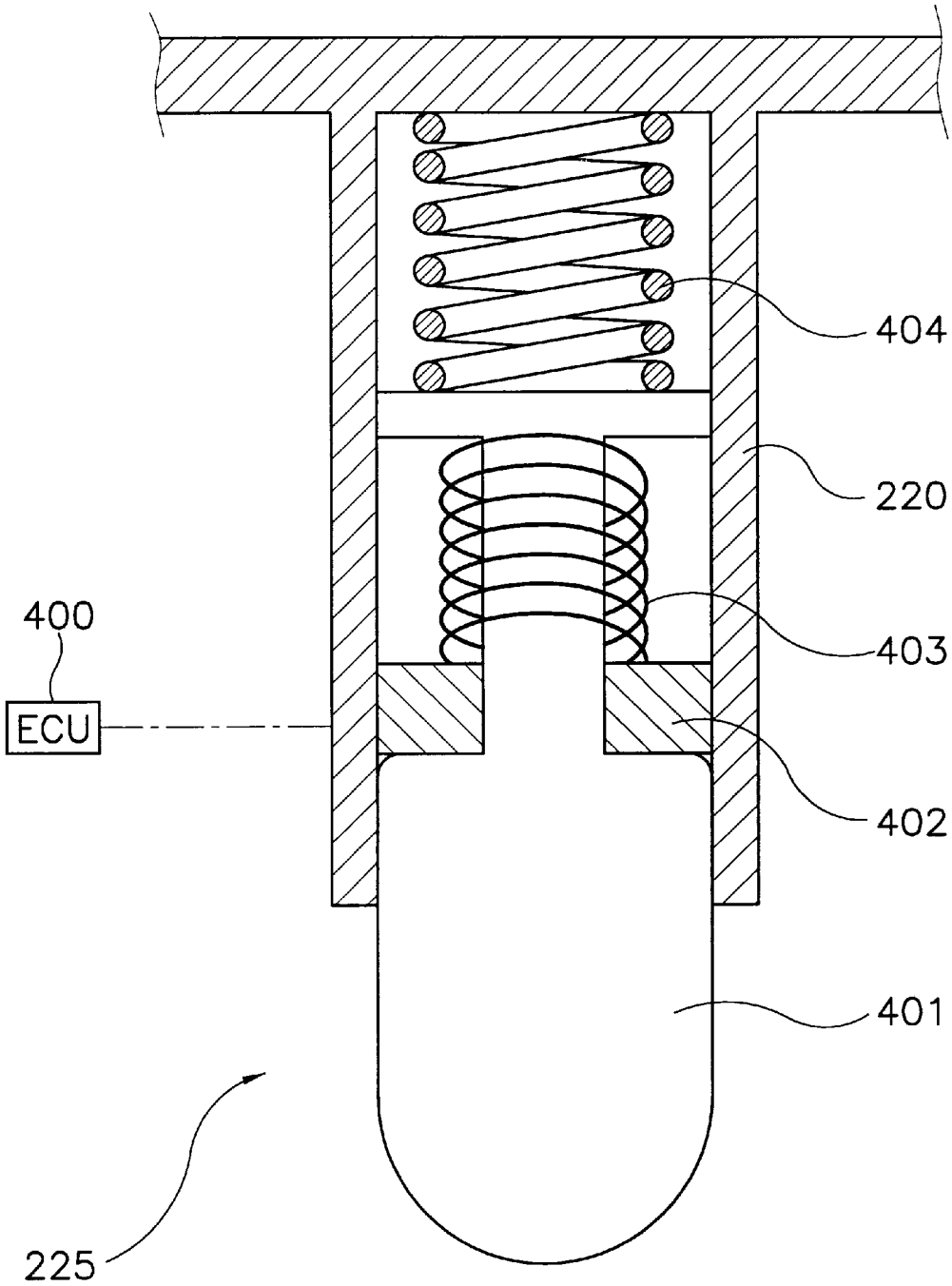
FIG. 5 is an enlarged view of a solenoid valve assembly shown in FIG. 4.

As shown in FIG. 5 in detail, solenoid valve assembly 225 includes a piston valve 401 which is moved up and down for closing and opening port 350, a magnet 402 coupled to an upper surface of piston valve 401, a coil 403 which makes an electromagnetic action with respect to magnet 402 as a current is applied thereto, and a spring 404 for downwardly biasing piston valve 401.

When the current is applied to coil 403, magnet 402 is move up so that piston valve 401 is also moved up to open port 350. Accordingly, the liquid is introduced into ice tray 340 from liquid tank 260 or from supply pipe 250.

Referring again to FIG. 4, T-connector 235 includes a horizontal pipe 240 and a vertical pipe 230 integrally formed at a center of horizontal pipe 240. A first end of horizontal pipe 240 is adapted for connecting to supply pipe 250 of the household water supply system. That is, the first end of horizontal pipe 240 is press-fitted into supply pipe 250.

In addition, a second end of horizontal pipe 240 is adapted for being connected to liquid tank 260. That is, the second end of horizontal pipe 240 is press-fitted into a pipe 265 integrally formed with liquid tank 260. In order to prevent a leakage, a sealing ring, such as O-ring, is provided in pipe 265. First cap 245 seals the first end of horizontal pipe 240 when the second end of horizontal pipe 240 is connected to liquid tank 260, and second cap 247 seals the second end of horizontal pipe 240 when the first end of horizontal pipe 240 is connected to supply pipe 250 of the household water supply system. First and second caps 245 and 247 have first and second holes 255 and 257 for receiving the first and second ends of horizontal pipe 240, respectively.

In refrigerator 100 according to the present invention, the liquid is supplied into ice tray 340 as follows.

Figure 6:
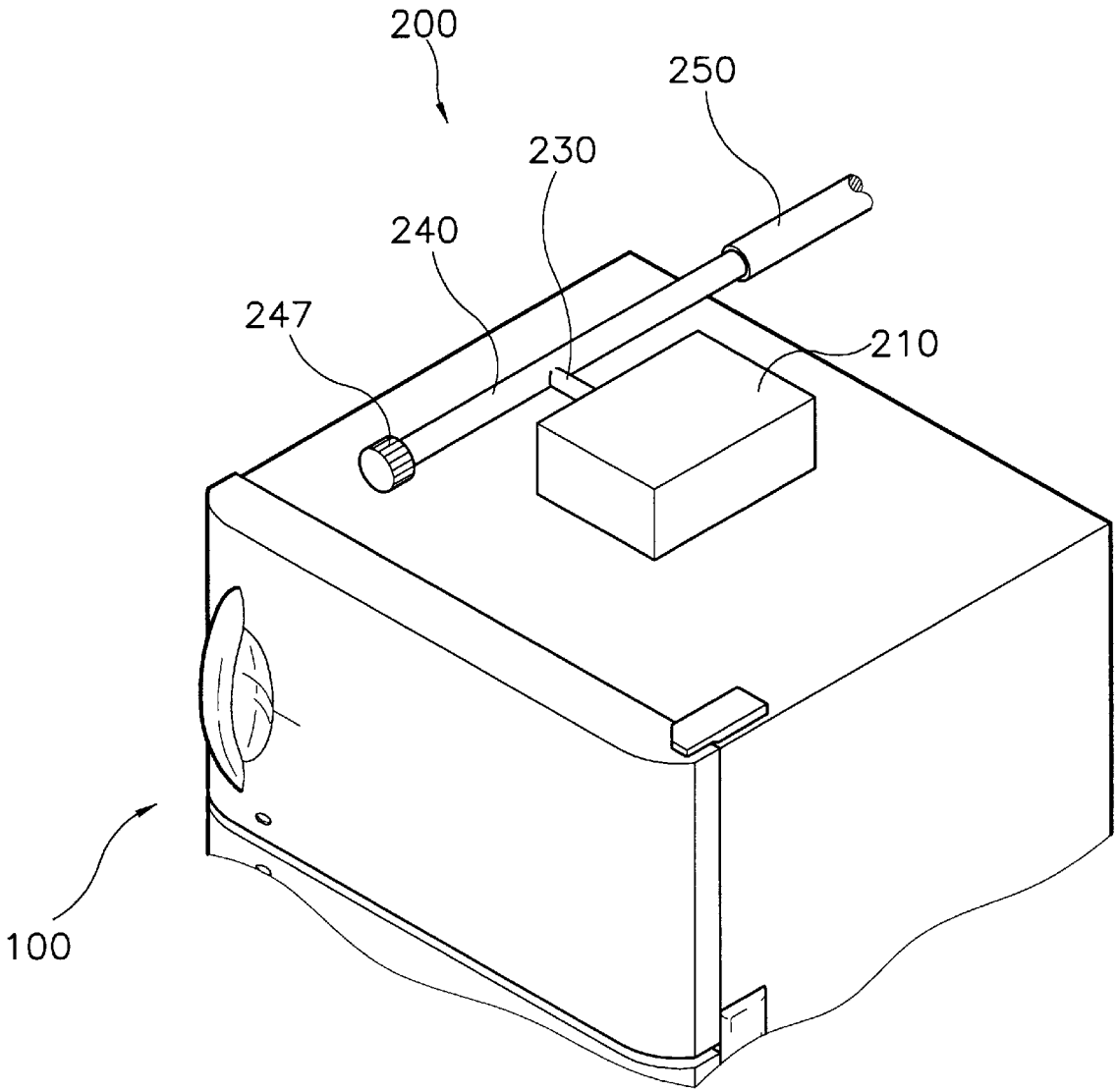
FIG. 6 is a perspective view showing a liquid supplying device for supplying water from a household water supply system.

Firstly, if a user want to supply the liquid from the household water supply system, the user seals the second end of horizontal pipe 240 by using second cap 247 and connects the first end of horizontal pipe 240 to supply pipe 250 of the household water supply system, as shown in FIG. 6.

In this state, electric control unit 400 sends an operating signal to solenoid valve assembly 225, so that piston valve 401 is moved up to open port 350 of valve box 210. Accordingly, the liquid is introduced into ice tray 340 through supply pipe 250, valve box 210, circular chamber 310 and duct 330.

At this time, revolution per minute sensor 325 of rotating fan assembly 320 installed in circular chamber 310 detects revolutions of wings 324 and sends the detected data to electric control unit 400. The standard revolution number of wings 324 according to the amount of the liquid being supplied into ice tray 340 are obtained through a plurality of tests and are pre-set in electric control unit 400.

When the revolution number of wings 324 reach a predetermined value, electric control unit 400 shuts off the current applied to coil 403 of solenoid valve assembly 225 so that piston valve 401 is moved downward by the biasing force of spring 404 thereby closing port 350. Therefore, the liquid cannot flow into ice tray 340.

When the ice making process is completed, electric control unit 400 operates reversible motor 450 to rotate ice tray 340 at the angle of 180 degrees. Accordingly, ice cubes contained in ice tray 340 are dropped from ice tray 340 and stored in ice reservoir 410.

Then, electric control unit 400 again applies the current to coil 403 of solenoid valve assembly 225 so that port 350 is opened again and the liquid is supplied into ice tray 340 in the manner as mentioned above.

On the other hand, if the user want to supply the liquid from liquid tank 260, the user seals the first end of horizontal pipe 240 by using first cap 245 and connects the second end of horizontal pipe 240 to pipe 265 of liquid tank 260.

Accordingly, the liquid is supplied into ice tray 340 from liquid tank 260. In this case, the liquid is supplied through the similar route as mentioned above, so detailed description thereof will be omitted.

As described above, the liquid supplying device of the present invention supplies the liquid from the upper portion of the ice tray, so there is no need to provide a pump for pumping the liquid into the upper portion of the ice tray.

In addition, since the liquid supplying device is separately installed on the upper surface of the housing, there is no need to provide a space in the refrigerator for installing the liquid supplying device. Accordingly, the usable space in the refrigerator increases and manufacturing costs decrease.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A refrigerator comprising:

a housing having a refrigerating chamber, a freezing chamber, and an evaporator chamber which is disposed at a rear portion of the freezing chamber;

an ice tray disposed in the freezing chamber;

a motor assembly for rotating the ice tray when a liquid filled in the ice tray is frozen, the motor assembly being installed in the evaporator chamber;

a first means for receiving the liquid from a household water supply system or from a liquid tank, the first means being installed on an upper surface of the housing and alternatively connected to the household water supply system or to the liquid tank;

a second means for guiding the liquid from the first means to the ice tray;

a third means for detecting an amount of the liquid flowed into the ice tray;

a fourth means for adjusting the amount of the liquid being supplied into the ice tray; and an electric control unit for operating the fourth means based on an electric signal inputted from the third means.

2. The refrigerator as claimed in claim 1, wherein the first means includes a valve box coupled to the upper surface of the housing, a T-connector connected to one side of the valve box for allowing the liquid to flow from the liquid tank or the household water supply system into the valve box, and first and second caps for selectively sealing either end of the T-connector.

3. The refrigerator as claimed in claim 2, wherein the T-connector includes a horizontal pipe and a vertical pipe integrally formed at a center of the horizontal pipe and connected to the valve box, a first end of the horizontal pipe is adapted for connecting to the household water supply system, a second end of the horizontal pipe is adapted for connecting to the liquid tank, the first cap seals the first end of the horizontal pipe when the second end of the horizontal pipe is connected to the liquid tank, and the second cap seals the second end of the horizontal pipe when the first end of the horizontal pipe is connected to the household water supply system.

4. The refrigerator as claimed in claim 2, wherein the second means includes a circular chamber which is formed between an upper wall of the housing and an upper wall of the freezing chamber so that the circular chamber is communicated with the valve box, and a duct integrally formed at the upper wall of the freezing chamber so as to communicated with the circular chamber and extended by a predetermined distance towards the ice tray.

5. The refrigerator as claimed in claim 4, wherein the duct is provided at an outer wall thereof with a heating coil for preventing the duct from freezing.

6. The refrigerator as claimed in claim 4, wherein the housing is formed at the upper surface thereof with an opening which is connected to the circular chamber, and the valve box is integrally formed at an underside thereof with a port extending downward, the port being inserted into the opening so as to secure the valve box to the upper surface of the housing.

7. The refrigerator as claimed in claim 6, wherein the third means includes a rotating fan assembly installed in the circular chamber, the rotating fan assembly having a cylindrical boss, a plurality of wings provided around the cylindrical boss, and a revolution per minute sensor for detecting revolutions of the wings, the revolution per minute sensor being installed at a predetermined portion of the cylindrical boss for sending a detected data to the electric control unit.

8. The refrigerator as claimed in claim 7, wherein one of the wings is arranged corresponding to a position of the port of the valve box so that the wings rotate by a hydraulic pressure of the liquid dropped from the port.

9. The refrigerator as claimed in claim 7, wherein the fourth means includes a cylinder integrally formed at an inner upper wall of the valve box and a solenoid valve assembly installed in the cylinder.

10. The refrigerator as claimed in claim 9, wherein the cylinder is arranged in line with the port.

11. The refrigerator as claimed in claim 9, wherein the solenoid valve assembly includes a piston valve which is moved up and down for closing and opening the port, a magnet disposed on the piston valve, a coil which makes an electromagnetic action with respect to the magnet as a current is applied thereto, and a spring for downwardly biasing the piston valve.

12. The refrigerator as claimed in claim 9, wherein the motor assembly includes a reversible motor installed in the evaporator chamber and a rotating shaft integrally formed with the reversible motor, the rotating shaft extending into the freezing chamber and being connected to the ice tray for rotating the ice tray, the reversible motor rotating the rotating shaft at an angle of 180 degrees.

* * * * *